US006744414B2

(12) United States Patent
Lee et al.

(10) Patent No.: US 6,744,414 B2
(45) Date of Patent: Jun. 1, 2004

(54) ELECTRO-LUMINESCENCE PANEL

(75) Inventors: Han Sang Lee, Seoul (KR); Sung Joon Bae, Kyounggi-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 345 days.

(21) Appl. No.: 09/903,617

(22) Filed: Jul. 13, 2001

(65) Prior Publication Data

US 2002/0005825 A1 Jan. 17, 2002

(30) Foreign Application Priority Data

Jul. 15, 2000 (KR) ..... 2000-40755

(51) Int. Cl.[7] ..... G09G 3/30
(52) U.S. Cl. ..... 345/76; 345/77
(58) Field of Search ..... 345/60, 76, 77, 345/211, 63; 315/169.1, 169.3

(56) References Cited

U.S. PATENT DOCUMENTS 6,091,203 A * 7/2000 Kawashima et al. ..... 315/169.3
6,380,689 B1 * 4/2002 Okuda ..... 315/169.3
6,417,825 B1 * 7/2002 Stewart et al. ..... 345/77
6,448,718 B1 * 9/2002 Battersby ..... 315/169.3
6,496,168 B1 * 12/2002 Tomida ..... 345/76

* cited by examiner

*Primary Examiner*—Regina Liang
(74) *Attorney, Agent, or Firm*—Birch, Stewart, Kolasch & Birch, LLP

(57) ABSTRACT

An electro-luminescence panel that is adaptive for displaying a gray scale of picture. In the panel, a plurality of data lines are arranged in such a manner to cross a plurality of gate lines. electro-luminescence cells are provided at each intersection between the gate lines and the data lines. A cell driving circuit is provided at each of the electro-luminescence cells to respond to a signal at the data lines, thereby controlling a light quantity emitted from the electro-luminescence cells. A data driver supplies a voltage pixel signal to the data lines. A plurality of current drivers responds to the voltage pixel signal to control a current amount going through the data lines from the cell driving means.

24 Claims, 9 Drawing Sheets

ELECTRO-LUMINESCENCE PANEL

BACKGROUND OF THE INVENTION

1. Field of the Invention

This invention relates to an electro-luminescence display (ELD), and more particularly to an electro-luminescence panel that is adaptive for displaying a gray scale of picture.

2. Description of the Related Art

Generally, an electro-luminescence (EL) panel converts an electrical signal into a light energy to thereby display a picture corresponding to video signals. As shown in FIG. 1, the EL panel includes gate line pairs GL and /GL and data lines DL arranged on a glass substrate 10 in such a manner to cross each other, and pixel elements PE arranged at each intersection between the gate line pairs GL and /GL and the data lines DL. Each pixel element PE is driven when gate signals are applied to the gate line pairs GL and /GL and generates a light corresponding to a magnitude of pixel signals applied to the data lines DL.

In order to drive such an EL panel, a gate driver 12 is connected to the gate line pairs GL and /GL while a data driver 14 is connected to the data lines DL. The gate driver 12 drives the gate line pairs GL and /GL sequentially. The data driver 14 applies pixel signals to the pixels PE via the data lines DL.

As shown in FIG. 2, each of the pixel elements RE driven with the gate driver 12 and the data driver 14 includes an EL cell ELC connected to a ground voltage line GNDL, and a cell driving circuit 16 for driving the EL cell ELC. The cell driving circuit 16 includes a first PMOS thin film transistor (TFT) MP1 connected among first and second nodes N1 and N2 and the EL cell ELC, a second PMOS TFT MP2 connected among a gate line GL, the second node N2 and the EL cell ELC, and a capacitor C1 connected between the first and second nodes N1 and N2.

The capacitor C1 charges a voltage of a pixel signal when the pixel signal is received from the data line DL and applies the charged pixel voltage to the gate electrode of the first PMOS TFT MP1. The first PMOS TFT MP1 is turned on by the pixel voltage charged in the first capacitor C1, to thereby apply a supply voltage VDD applied, via the first node N1, from a voltage supply line VDDL to the EL cell ELC. At this time, a channel width of the first PMOS TFT MP1 is varied depending on a voltage level of a pixel signal applied from the capacitor C1 to control an amount of a current applied to the EL cell ELC.

The EL cell ELC generates a light corresponding to a current amount applied from the first PMOS TFT MP1. The second PMOS TFT MP2 responds to a gate signal GLS, as shown in FIG. 3, applied from the gate line GL to selectively connect the second node N2 to the EL cell ELC. More specifically, the second PMOS TFT MP2 connects the second node N2 to the EL cell ELC at a time interval when the gate signal GLS is enabled at a low logic, to thereby charge the pixel signal into the capacitor C1.

In other words, the second PMOS TFT MP2 forms a current path of the first capacitor C1 at a time interval when the gate signal GLS at the gate line GL is enable. The capacitor C1 charges a pixel signal at said enabling interval of the gate signal GLS and applies the charge pixel signal to the gate electrode of the first PMOS TFT MP1. Thus, the first PMOS TFT MP1 controls its channel width depending on a voltage level of the pixel signal charged in the capacitor C1, to thereby determine a current amount flowing from the first node N1 into the EL cell ELC.

The cell driving circuit 16 further includes a third PMOS TFT MP3 responding to a gate signal GLS at the gate line GL, and a fourth PMOS TFT MP4 responding to an inverted gate signal /GLS from the gate bar line /GL. The third PMOS TFT MP3 is turned on by the gate signal GLS from the gate line GL, to thereby connect the capacitor C1 connected to the first node N1 and the drain electrode of the first PMOS TFT MP1 to the data line DL. In other words, the third PMOS TFT MP3 responds to a low logic of gate signal GLS to send a pixel signal at the data line DL to the first node N1.

The fourth PMOS TFT MP4 is turned on by an inverted gate signal /GLS from the gate bar line /GL, to thereby connects the first node N1 to which the capacitor C1 and the drain electrode of the first PMOS TFT MP1 have been connected to the voltage supply line VDDL. At a time interval when the fourth PMOS TFT MP4 has been turned on, a supply voltage VDD at the voltage supply line VDDL is applied, via the first node N1 and the first PMOS TFT MP1, to the EL cell ELC. The EL cell ELC generates a light corresponding to an amount of the supply voltage VDD from the voltage supply line VDDL.

Since the EL cell driving circuit 16 supplies a current amount of a pixel signal from the data line DL to the EL cell ELC as it is at a time interval when the gate signal GLS at the gate line GL is enabled at a low logic, the data driver should have a high capacity of current source. However, the data driver 14 fails to increase a maximum current amount to be supplied to the EL cells ELC for one line because it should drive pixel elements for one line simultaneously.

In other words, the conventional EL panel fails to increase a maximum current amount required for obtaining a maximum brightness, that is, a current margin of the pixel signal because it should apply a forward current signal to each pixel element. For this reason, a current difference between gray scale levels of a video signal is largely reduced into a value of approximately several $\mu$A. If a current difference between the gray scale levels is set to several $\mu$A, a data driver integrated circuit (IC) chip must have an ability to control a current at a range of several $\mu$A accurately. However, it was very difficult to manufacture a data driver IC chip capable of controlling a current at a range of several $\mu$A accurately. As a result, the conventional EL panel had a large difficulty in displaying a gray scale of picture.

SUMMARY OF THE INVENTION

Accordingly, it is an object of the present invention to provide an electro-luminescence panel that is adaptable for displaying a gray scale of a picture.

A further object of the present invention is to provide an electro-luminescence panel that is capable of applying a large current signal to a pixel.

In order to achieve these and other objects of the invention, an electro-luminescence panel according to one embodiment of the present invention includes a plurality of gate lines; a plurality of data lines arranged in such a manner to cross the gate lines; electro-luminescence cells provided at each intersection between the gate lines and the data lines; cell driving means, being provided at each of the electro-luminescence cells, for responding to a signal at the data lines to control a light quantity emitted from the electro-luminescence cells; a data driver for supplying a voltage pixel signal to the data lines; and a plurality of current drivers for responding to the voltage pixel signal to control a current amount going through the data lines from the cell driving means.

In the electro-luminescence display, the cell driving means includes a first current path for allowing a current to flow into the data line; and a second current path for allowing a current having several to tens of times the difference in quantity in comparison to a current amount going through the first current path to be applied to the electro-luminescence cell.

Each of the current drivers includes a transistor for responding to the voltage pixel signal to control a current amount flowing from the data line into a low voltage source.

The electro-luminescence display further includes a resistor connected between the transistor and the low voltage source.

In the electro-luminescence display, the low voltage source generates any one of a ground voltage and a negative voltage.

Each of the current drivers includes a resistor voltage divider connected between the data driver and the low voltage source to generate at least two divided-voltage signals; and at least two transistors connected, in series, between the data line and the low voltage source to respond to said at least two divided-voltage signals.

The electro-luminescence display further includes a resistor connected between said at least two transistors and the low voltage source.

In the electro-luminescence display, the low voltage source generates any one of a ground voltage and a negative voltage.

Each of the current drivers includes a current repeater, being connected between the data line and the low voltage source, for responding to the voltage pixel signal to control a current amount flowing from the data line into the low voltage source.

In the electro-luminescence display, the low voltage source generates any one of a ground voltage and a negative voltage. The current drivers are provided within the data driver. Alternatively, the current drivers are provided between the data driver and the cell driving means.

An electro-luminescence display according to another embodiment of the present invention includes a plurality of gate lines; a plurality of data lines arranged in such a manner to cross the gate lines; electro-luminescence cells provided at each intersection between the gate lines and the data lines; cell driving means, being provided at each of the electro-luminescence cells, for responding to a signal at the data lines to control a light quantity emitted from the electro-luminescence cells; a data driver for supplying a voltage pixel signal to the data lines; a gate driver for supplying a driving signal to the gate lines; a plurality of current drivers for responding to the voltage pixel signal to control a current amount going through the data lines from the cell driving means; and a plurality of pads provided at the current drivers to receive the voltage pixel signal.

In the electro-luminescence display, each of the current drivers includes a low voltage source having any one of a ground voltage and a negative voltage; a transistor provided between the data line and the low voltage source; and a resistor provided between the transistor and the low voltage source.

Each of the current drivers includes a low voltage source having any one of a ground voltage and a negative voltage; at least three resistors connected, in series, between the pad and the low voltage source; and at least two transistors connected, in series, between the data line and the low voltage source.

Each gate electrode of the transistors are connected between the resistors.

Each of the current drivers includes a low voltage source having any one of a ground voltage and a negative voltage; a resistor and a first transistor connected, in series, between the pad and the low voltage source; and a second transistor provided between the data line and the low voltage source.

In the electro-luminescence display, a source electrode and a gate electrode of the first transistor are electrically connected to each other, the gate electrode of the first transistor is connected to a gate electrode of the second transistor.

The electro-luminescence display further includes a third transistor provided between the second transistor and the data line.

In the electro-luminescence display, a gate electrode of the third is connected to the source electrode of the first transistor, and a drain electrode of the third transistor is connected to the gate electrodes of the first and second transistors.

The electro-luminescence display further includes a third transistor provided between the resistor and the first transistor; and a fourth transistor provided between the data line and the second transistor.

In the electro-luminescence display, a source electrode of the third transistor is connected to the gate electrodes of the first and second transistors.

The electro-luminescence display further includes a bias voltage source connected to gate electrodes of the third and fourth transistors to apply a driving voltage for driving the third and fourth transistors.

In the electro-luminescence display, the resistor is a variable resistor.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
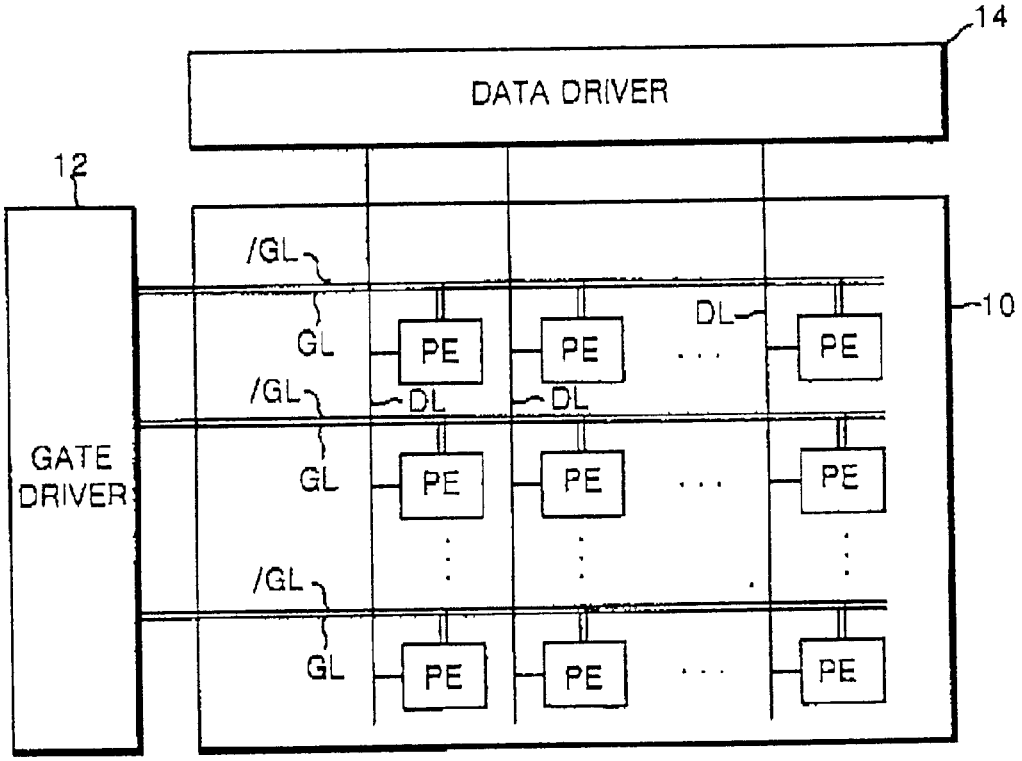
FIG. 1 CONVENTIONAL ART
FIG. 1 is a schematic block circuit diagram showing a configuration of a conventional electro-luminescence panel.
Figure 2:
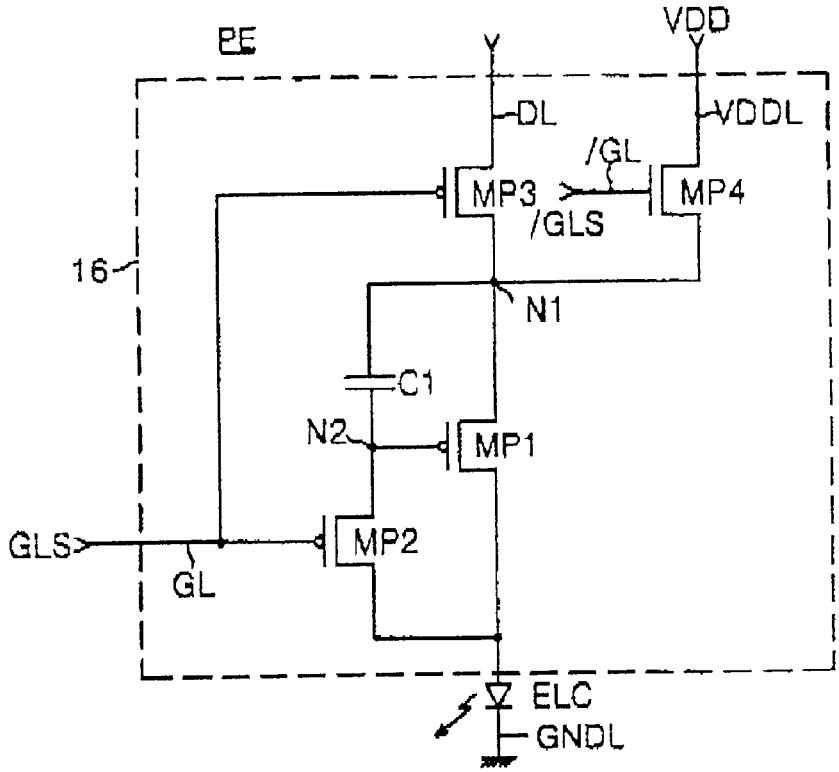
FIG. 2 CONVENTIONAL ART
FIG. 2 is a detailed circuit diagram of the pixel element shown in FIG. 1.
Figure 3:
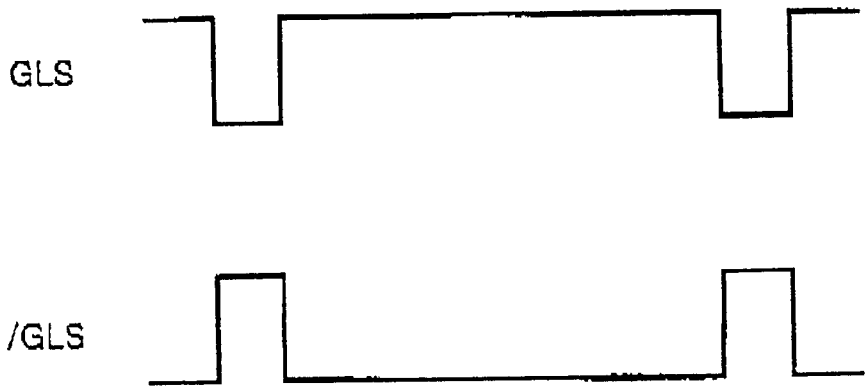
FIG. 3 CONVENTIONAL ART
FIG. 3 is a waveform diagram of a gate signal applied to the pixel element shown in FIG. 2.
Figure 4:
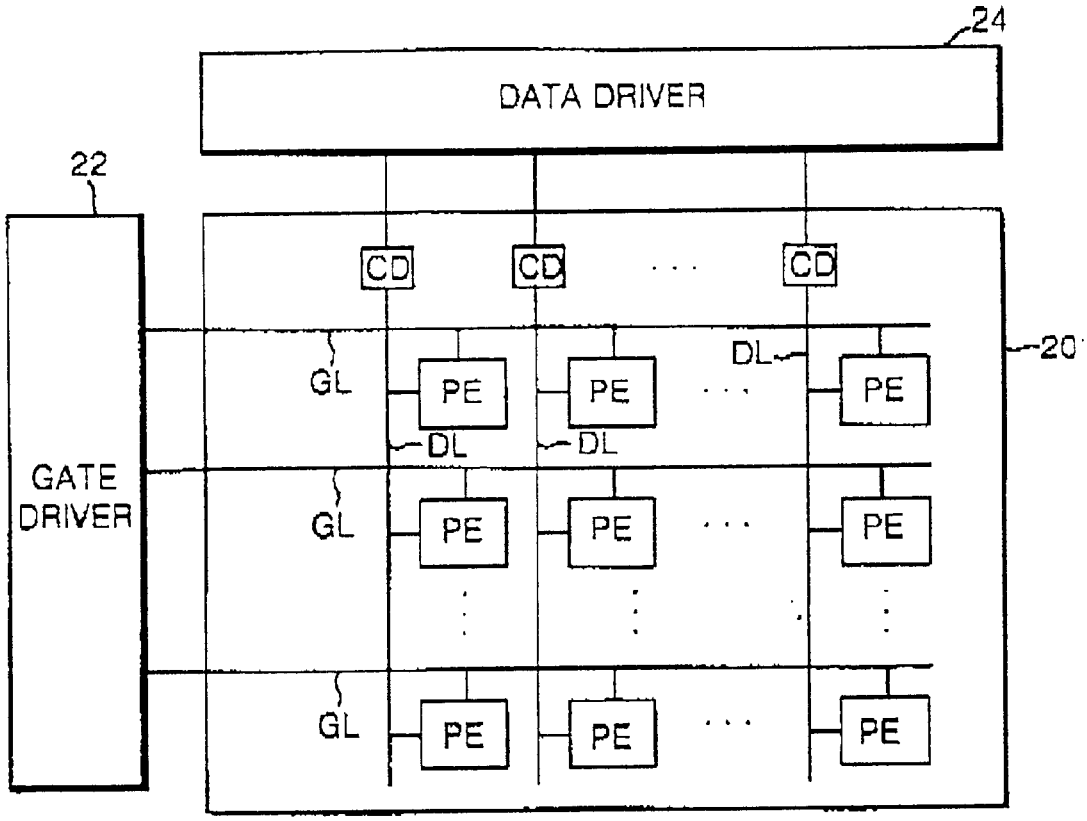
FIG. 4 is a schematic block circuit diagram showing a configuration of an electro-luminescence panel according to an embodiment of the present invention.

Referring to FIG. 4, there is shown an electroluminescence (EL) panel according to an embodiment of the present invention.

The EL panel includes gate lines GL and data lines DL arranged on a glass substrate 20 in such a manner to cross each other, pixel elements PE arranged at each intersection between the gate lines GL and the data lines DL, and current drivers CD (or line drivers) provided between the data lines DL and a data driver 24.

Each of the current drivers CD responds to a pixel signal applied from the data driver 24 to control a current signal flowing from the pixel element PE into itself over the data line DL. This current driver CD allows a current signal varying in accordance with the pixel signal to flow in the pixel element PE.

The gate lines GL of the EL panel are connected to a gate driver 22 while the current drivers CD are connected to the data driver 24. The gate driver 22 drives the gate lines GL sequentially. The data driver 24 applies pixel voltage signals for one line to the current drivers CD. Each of the current drivers CD converts a pixel voltage signal from the data driver 24 into a backward pixel current signal and applies the converted pixel current signal to the pixel element PE. In other words, the current driver CD controls a current amount passing through the data line from the pixel element PE to thereby increase a maximum current amount in the pixel element PE. That is to say, the current driver CD enlarges a difference in a current amount according to a gray scale level. Accordingly, the present EL panel can display a gray scale of picture.

Figure 5:
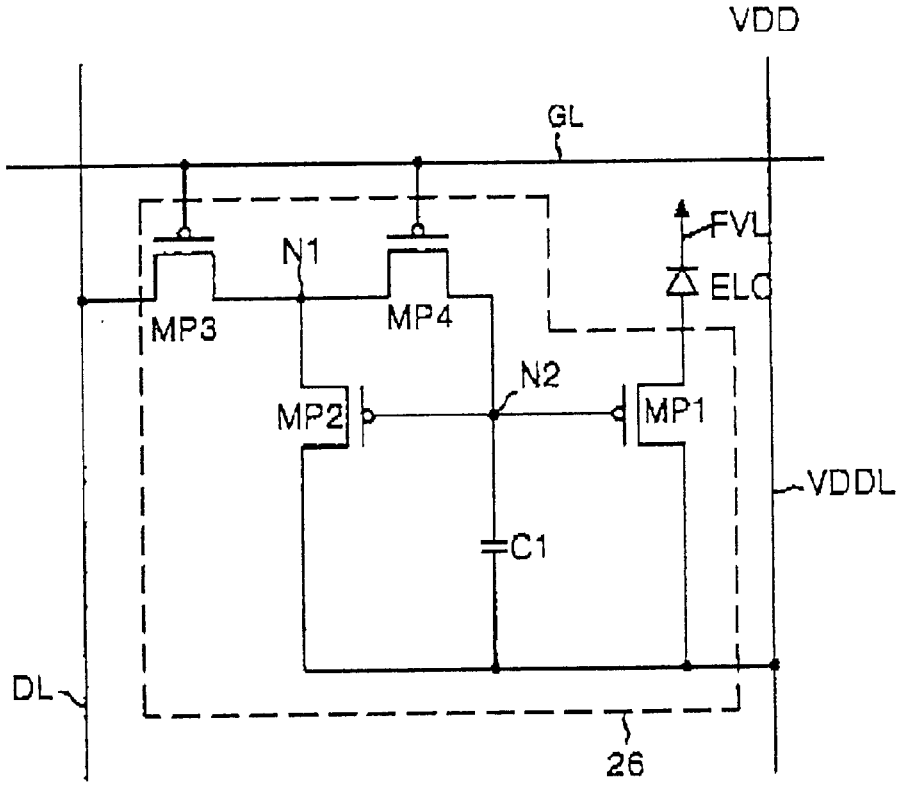
FIG. 5 is a detailed circuit diagram of the pixel element shown in FIG. 4.

FIG. 5 is a detailed circuit diagram of the pixel element PE shown in FIG. 4.

Referring to FIG. 5, the pixel element PE includes an EL cell ELC connected to a first low-level line FVL, and a EL cell driving circuit 26 connected among the EL cell ELC, the data line DL and the gate line GL. The first low-level line FVL is connected to a ground voltage source (not shown) or a first low-level voltage source (not shown) generating a negative voltage. The EL cell driver 26 applies a forward current signal varying in accordance with a backward current amount at the data line DL to the EL cell ELC in a time interval at which a gate signal at the gate line GL is enabled.

To this end, the EL cell driver 26 includes first and second PMOS TFT's MP1 and MP2 connected to form a current mirror among the EL cell ELC, a first node N1 and a voltage supply line VDDL, and a capacitor C1 connected between a second node N2 and the voltage supply line VDDL. When the voltage supply line VDDL is connected to the data line DL, the capacitor C1 charges a signal current at the data line DL and commonly applies the charged signal current to the gate electrodes of the first and second PMOS TFT's MP1 and MP2. The first PMOS TFT MP1 is turned on by a signal current charged in the first capacitor C1, to thereby apply a supply voltage VDD at the voltage supply line VDDL to the EL cell ELC. At this time, a channel width of the first PMOS TFT MP1 is varied depending on an amount of the signal current charged in the capacitor C1 to control a current amount supplied from the voltage supply line VDDL to the EL cell ELC.

Then, the EL cell ELC generates a light corresponding toa current amount applied via the first PMOS TFT MP1 from the voltage supply line VDDL. The second PMOS TFT MP2 also controls a current amount flowing from the voltage supply line VDDL, via itself, into the data line DL, to thereby determine a current amount to flow into the EL cell ELC via the first PMOS TFT MP1.

The cell driving circuit 26 further includes third and fourth PMOS TFT's MOP and MP4 commonly responding to a gate signal at the gate line GL. The third PMOS TFT MP3 is turned on when a low logic of gate signal is received from the gate line GL. If the third PMOS TFT MP3 is turned on, then the source electrode of the third PMOS TFT MP3 connected to the first node N1 is connected to the data line DL. In other words, the third PMOS TFT MP3 responds to a low logic of gate signal to form a current path extending from the voltage supply line VDDL, via the second PMOS TFT MP2, the first node N1 and itself, into the data line DL.

The fourth PMOS TFT MP4 is turned on when a low logic gate signal is received from the gate line GL. If the fourth PMOS TFT MP4 is turned on, then a second node N2 is connected to the data line DL via the first node N1 to which the gate electrodes of the first and second PMOS TFT's MP1 and MP2 and one terminal of the capacitor C1. In other words, the third and fourth PMOS TFT MP3 and MP4 is turned on in a time interval when a gate signal at the gate line GL remains at a low logic, to thereby charge electrical charges (or signal current) corresponding to a current amount flowing from the voltage supply line VDDL into the data line DL in the capacitor C1.

Furthermore, the EL cell driving circuit according to the embodiment of the present invention may include a resistor (not shown) connected between the gate line GL and the gate electrode of the third PMOS TFT MP3. This resistor delays a gate signal to be applied from the gate line GL into the gate electrode of the third PMOS TFT MP3. If a gate signal applied to the gate electrode of the third PMOS TFT MP3 is delayed, then the third PMOS TFT MP3 is turned off more lately than the fourth PMOS TFT MP4. Thus, an electrical charge amount charged in the capacitor C1 is not leaked at the falling edge of the gate signal. As a result, the EL cell ELC can accurately generate a light quantity corresponding to a current amount at the data line DL. Furthermore, the EL panel can display a picture corresponding to video signals (or image signals) with no deterioration or distortion.

Figure 6:
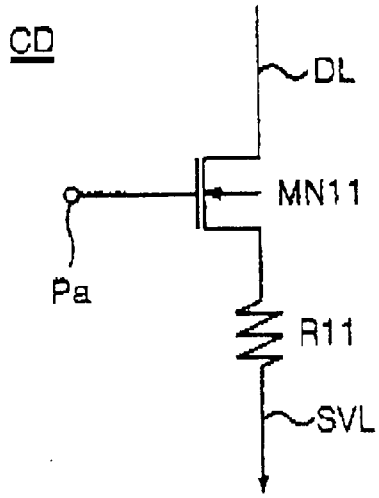
FIG. 6 is a circuit diagram of a current driver according to a first embodiment of the present invention.

FIG. 6 is a circuit diagram of a current driver CD according to a first embodiment of the present invention.

Referring to FIG. 6, the current driver CD includes a serial connection of a NMOS transistor MN11 and a resistor R11 between the data line DL and a second low-level line SVL. The gate electrode of the NMOS transistor MN1 is connected, via a pad Pa, to any one of output terminals of the data driver shown in FIG. 4. The second low-level line SVL is connected to a ground voltage source (not shown) or a second low-level voltage source (not shown) generating a negative voltage.

Figure 7:
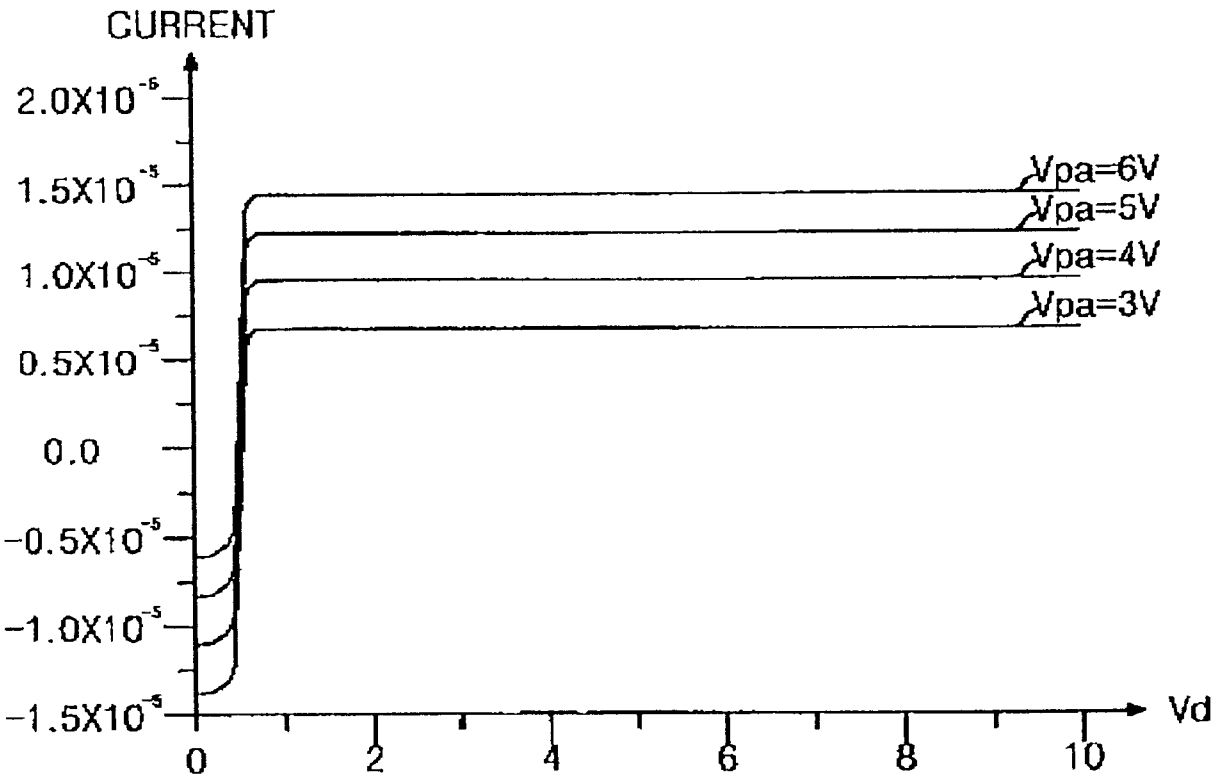
FIG. 7 is a graph representing a current characteristic of the current driver shown in FIG. 6.

The NMOS transistor MN11 responds to a pixel voltage applied from the pad Pa to control a current amount flowing from the data line DL, via the resistor R11, to the second low-level line SVL, In other words, as shown in FIG. 7, the NMOS transistor MN11 increases a backward signal current flowing from the data line DL by way of the resistor R11 in proportion to a level of the pixel voltage applied from the pad Pa. This is because a width of a channel defined between the drain electrode and the source electrode of the NMOS transistor MN11 is widened depending on a level of the pixel voltage applied from the pad Pa.

As described above, the current driver CD responds to the pixel voltage from the pad Pa to control a backward current amount at the data line DL, thereby supplying a large current to the EL cell ELC connected to the data line DL via a current mirror. Accordingly, the present EL panel can display a gray scale of picture.

Figure 8:
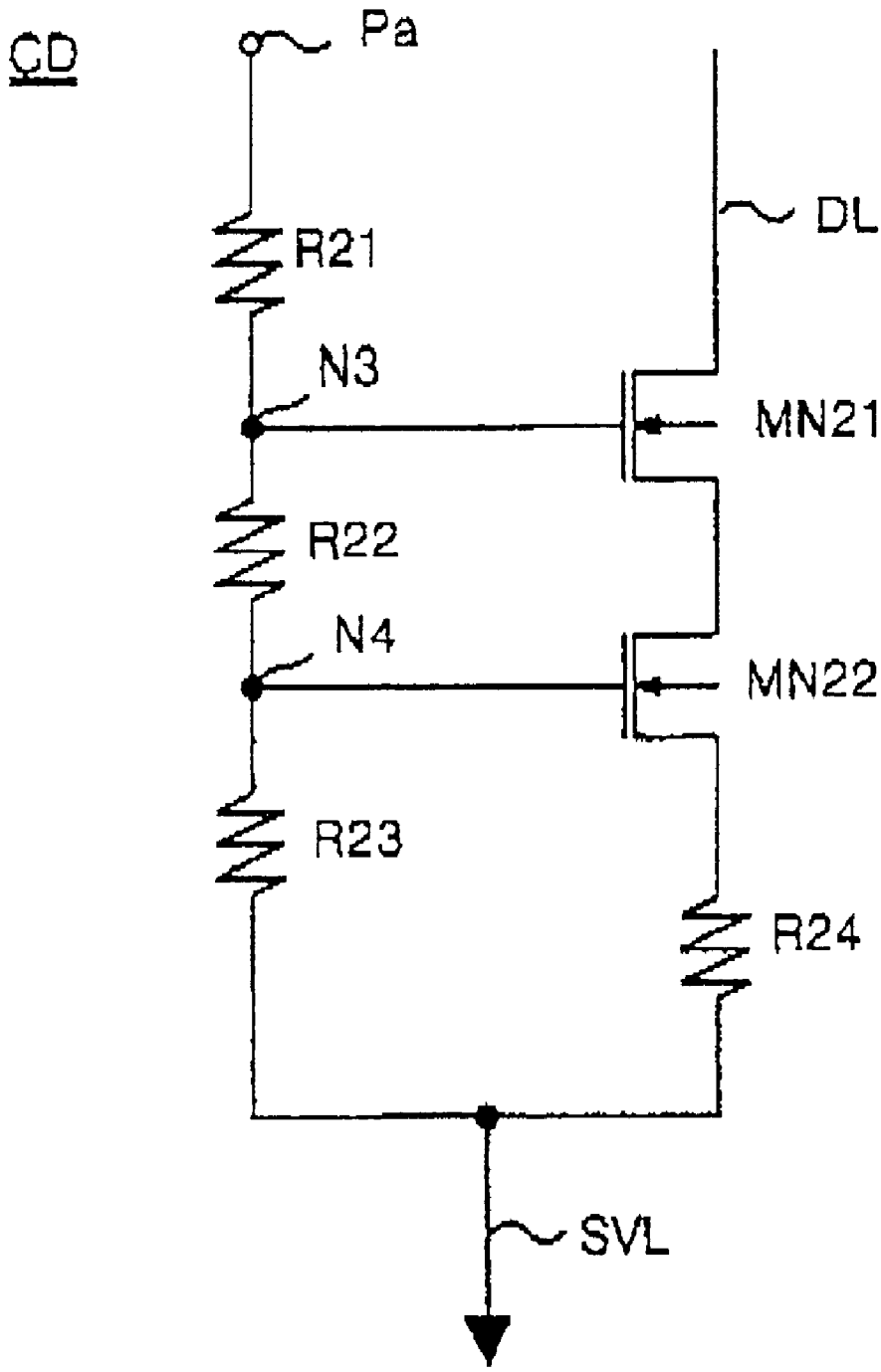
FIG. 8 is a circuit diagram of a current driver according to a second embodiment of the present invention.

FIG. 8 is a circuit diagram of a current driver CD according to a second embodiment of the present invention.

Referring to FIG. 8, the current driver CD includes a serial connection of first to third resistors R21 to R23 between the pad Pa and the second low-level line SVL, and a serial connection of first and second NMOS transistor MN21 and MN22 and a fourth resistor R24.

The pad Pa is connected to any one of the data drivers 24 shown in FIG. 4 to receive a pixel voltage supplied from the data driver 24. The first to third resistors R21 to R23 divides a pixel voltage at the pad Pa to generate first and second divided voltages Vd1 and Vd2. The first divided voltage Vd1 emerges at a third node N3 to which the first and second resistors R21 and R22 are connected, whereas the second divided voltage Vd2 emerges at a fourth node N4 to which the second and third resistors R22 and R23.

The first NMOS transistor MN21 responds to the first divided voltage Vd1 applied from the third node N3 to the gate electrode thereof to control a current amount flowing from the data line DL into the second NMOS transistor MN2. At this time, a current amount flowing the data line DL into the second NMOS transistor MN22 is more increased as the first divided voltage Vd1 at the third node N3 goes larger. The second NMOS transistor MN22 responds to the second divided voltage Vd2 applied from the fourth node N4 to the gate electrode thereof to control a current amount flowing from the first NMOS transistor MN21, via the fourth resistor R24, into the second low-level line SVL. At this time, a current amount passing through the fourth resistor R24 is more increased as the second divided voltage Vd2 at the fourth node N4 goes larger. As a result, the first and second transistors MN21 and MN22 provide a control such that a backward current flowing from the data line Dl into the second low-level line SVL is increased in proportion to a pixel voltage at the pad Pa as shown in FIG. 7. This is caused by a fact that a width of a channel width defined between the drain electrode and the source electrode of each of the first and second NMOS transistors MN21 and MN22.

As described above, the current driver CD responds to a pixel voltage to control a backward current amount at the data line DL, thereby applying a large current to the EL cell ELC connected to the data line DL by way of the current mirror. Accordingly, a difference in a current amount at the EL cell ELC for discriminating a gray scale level is enlarged such that a gray scale of picture can be displayed on the EL panel.

Figure 9:
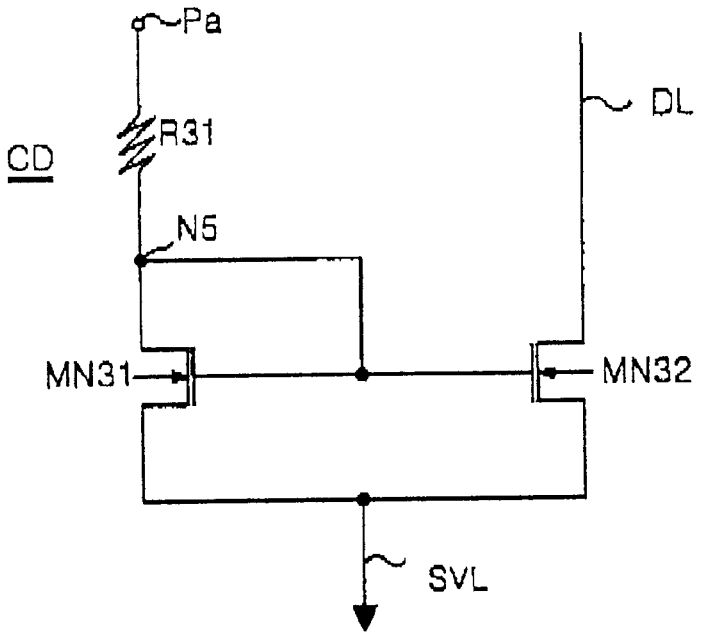
FIG. 9 is a circuit diagram of a current driver according to a third embodiment of the present invention.

FIG. 9 is a circuit diagram of a current driver according to a third embodiment of the present invention.

Referring to FIG. 9, the current driver CD includes a serial connection of a resistor R31 and a first NMOS transistor MN31 between the pad Pa and the second low-level line SVL, and a second NMOS transistor MN32 connected between the data line DL and the second low-level line SVL. The gate electrodes of the first and second NMOS transistors MN31 and MN32 are commonly connected to a fifth node N5 to which the resistor R31 and the drain electrode of the first NMOS transistor MN31 are connected. The first and second NMOS transistors MN31 and MN32 constructs a current repeater which allows a current amount flowing from the data line DL into the second low-level line SVL to be varied depending on a current amount applied to the fifth node N5.

More specifically, the first NMOS transistor MN31 serves as a diode connected between the fifth node N5 and the second low-level line SVL. Accordingly, a current $I_{N5}$ flowing at a fifth node N5 is given by the following equation:

$$I_{n5}=(V_{pa}-V_{th})/R_{31} \quad (1)$$

In the above equation (1), $V_{Pa}$ represents a pixel voltage supplied from the data driver to the pad Pa; $V_{th}$ does a threshold voltage of the NMOS transistor MN31; and $R_{31}$ does a resistance value of the resistor R31.

Meanwhile, a current $I_{DL}$ supplied from the data line DL to the drain electrode of the second NMOS transistor MN32 is given by the following equation:

$$I_{DL}=(\beta\times I_{n5})/\beta+2 \quad (2)$$

In the above equation (2), β is determined by a drain electrode (Id)/a gate electrode (Ig) of the second NMOS transistor MN32. As a result, a backward current $I_{DL}$ flowing from the data line DL, via the second NMOS transistor MN32, into the second low-level line SVL is proportional to a current $I_{N5}$ at the fifth node N5. In other words, a backward current $I_{DL}$ flowing from the data line DL, via the second NMOS transistor MN32, into the second low-level line SVL varies depending on a pixel voltage applied to the pad Pa as shown in FIG. 7.

As described above, the current driver CD responds to a pixel voltage to control a backward current amount at the data line DL, thereby allowing a large current to be applied to the EL cell ELC connected to the data line DL by way of the current mirror. Accordingly, a difference in a current amount at the EL cell ELC for discriminating a gray scale level is enlarged such that a gray scale of picture can be displayed on the EL panel.

Figure 10:
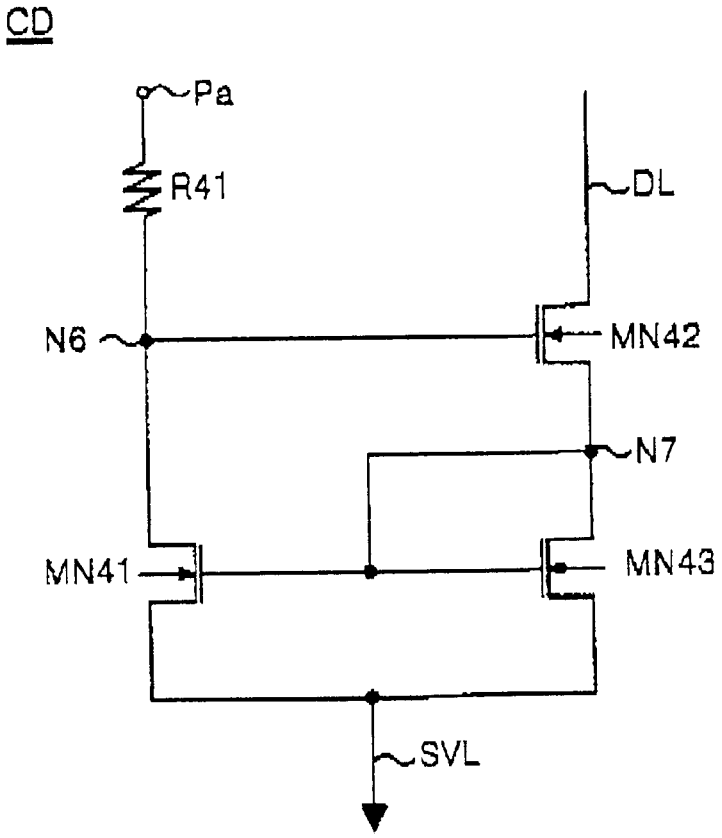
FIG. 10 is a circuit diagram of a current driver according to a fourth embodiment of the present invention.

FIG. 10 is a circuit diagram of a current driver according to a fourth embodiment of the present invention.

Referring to FIG. 10, the current driver CD includes a serial connection of a resistor R41 and a first NMOS transistor MN41 between the pad Pa and the second low-level line SVL, and a serial connection of second and third transistors MN42 and MN43 between the data line DL and the second low-level line SVL.

The gate electrodes of the first and second NMOS transistors MN41 and MN42 are commonly connected to a seventh node N7 to which the source electrode of the second NMOS transistor MN42 and the drain electrode of the third NMOS transistor MN43 are connected. The gate electrode of the second NMOS transistor MN42 is connected to a sixth node N6 to which the resistor R41 and the drain electrode of the first NMOS transistor MN41. The first and second NMOS transistors MN41 and MN42 constructs a current repeater which allows a current amount flowing from the data line DL into the second low-level line SVL to be varied depending on a current amount applied to the sixth node N6.

More specifically, the first NMOS transistor MN41 serves as a diode connected between the sixth node N6 and the second low-level line SVL. Also, the third NMOS transistor MN43 serves as a diode connected between the seventh node N7 and the second low-level line SVL. Accordingly, a current $I_{N6}$ flowing at a sixth node N6 is given by the following equation:

$$I_{n6}=(V_{pa}-V_{th})/R_{41} \quad (3)$$

In the above equation (3), $V_{Pa}$ represents a pixel voltage supplied from the data driver to the pad Pa; $V_{th}$ does threshold voltages of the NMOS transistors MN41 and MN43; and $R_{41}$ does a resistance value of the resistor R41.

Meanwhile, a current $I_{DL}$ supplied from the data line DL to the drain electrode of the second NMOS transistor MN42 is given by the following equation:

$$I_{DL}=(\beta\times I_{n6})/\beta+2 \quad (4)$$

In the above equation (4), β is determined by a drain electrode (Id)/a gate electrode (Ig) of the second NMOS transistor MN42. As a result, a backward current $I_{DL}$ flowing from the data line DL, via the second and third NMOS transistors MN42 and MN43, into the second low-level line SVL is proportional to a current $I_{N6}$ at the sixth node N6. In other words, a backward current $I_{DL}$ flowing from the data line DL, via the second and third NMOS transistors MN42 and MN43, into the second low-level line SVL varies depending on a pixel voltage $V_{Pa}$ applied to the pad Pa.

As described above, the current driver CD responds to a pixel voltage to control a backward current amount at the data line DL, thereby allowing a large current to be applied to the EL cell ELC connected to the data line DL by way of the current mirror. Accordingly, a difference in a current amount at the EL cell ELC for discriminating a gray scale level is enlarged such that a gray scale of picture can be displayed on the EL panel.

Figure 11:
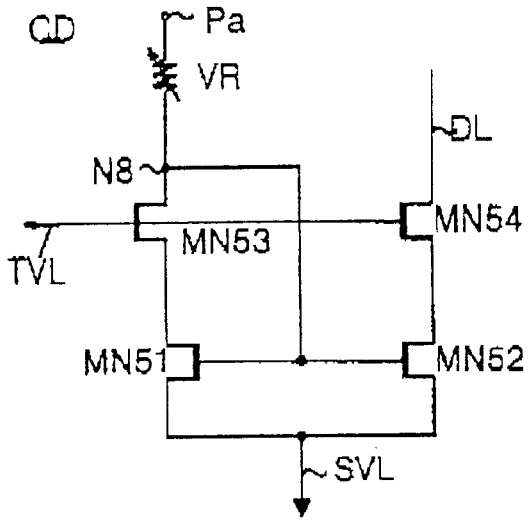
FIG. 11 is a circuit diagram of a current driver according to a fifth embodiment of the present invention.

FIG. 11 is a circuit diagram of a current driver according to a fifth embodiment of the present invention.

Referring to FIG. 11, the current driver CD includes a serial connection of a variable resistor VR and a first NMOS transistor MN51 between the pad Pa and the second low-level line SVL, and a second NMOS transistor MN52 connected between the data line DL and the second low-level line SVL. The gate electrodes of the first and second NMOS transistors MN51 and MN52 are commonly connected to an eighth node N8 to which the variable resistor VR is connected. The first and second NMOS transistors MN51 and MN52 constructs a current repeater which allows a current amount flowing from the data line DL into the second low-level line SVL to be varied depending on a current amount applied to the eighth node N8.

More specifically, the first NMOS transistor MN51 serves as a diode connected between the eighth node N8 and the second low-level line SVL. Accordingly, a current $I_{N8}$ flowing at the eighth node N8 is given by the following equation:

$$I_{n8}=(V_{pa}-V_{th})/R_{VR} \quad (5)$$

In the above equation (5), $V_{Pa}$ represents a pixel voltage supplied from the data driver to the pad Pa; $V_{th}$ does a threshold voltage of the first NMOS transistor MN51; and $R_{VR}$ does a resistance value of the variable resistor VR.

Accordingly, a current $I_{DL}$ supplied from the data line DL to the drain electrode of the second NMOS transistor MN52 is given by the following equation:

$$I_{DL}=(\beta\times I_{NS})/\beta+2 \quad (6)$$

In the above equation (6), β is determined by a drain electrode (Id)/a gate electrode (Ig) of the second NMOS transistor MN52. As a result, a backward current $I_{DL}$ flowing from the data line DL, via the second NMOS transistor MN52, into the second low-level line SVL is proportional to a current $I_{N8}$ at the eighth node N8. In other words, a backward current $I_{DL}$ flowing from the data line DL, via the second NMOS transistor MN52, into the second low-level line SVL varies depending on a pixel voltage applied to the pad Pa.

The current driver CD in FIG. 11 includes a third NMOS transistor MN53 connected between the eighth node N8 and the first NMOS transistor 51, and a fourth NMOS transistor MN54 connected between the data line DL and the second NMOS transistor MN52. All the gate electrodes of the third and fourth transistors MN53 and MN54 are connected to a third voltage line TVL. The third voltage line VTL is connected to a third voltage source (not shown) for keeping a constant voltage level. A voltage generating at the third voltage source is used as a bias voltage for driving the third and fourth NMOS transistors MN53 and MN54. The third NMOS transistor MN53 is turned on by a third voltage applied from the third voltage line TVL to the gate electrode thereof to constantly keep a voltage difference between the source and the drain of the first NMOS transistor MN1.

This is caused by a fact that the third NMOS transistor MN53 maintains a constant resistance value even though a voltage level at the eighth node N8 varies; whereas a variation in a resistance value of the first NMOS transistor MN51 is contrary to a voltage (or current amount) variation at the eighth node N8. If a voltage (or current amount) at the eighth node N8 is increased, then the first NMOS transistor MN51 has a low resistance value due to a large voltage at the eighth node N8. At this time, a resistance ratio of the first NMOS transistor MN51 to the third NMOS transistor MN53 is reduced, so that a voltage having a relatively large ratio is applied between the drain and the source of the third NMOS transistor MN53 while a voltage having a relatively reduced ratio is applied between the drain and the source of the first NMOS transistor MN51.

As a result, a voltage applied between the drain electrode and the source electrode of the first NMOS transistor MN51 does not almost vary even though a voltage (or current amount) at the eighth node N8 is increased. Otherwise, when a voltage (or current amount) at the eighth node N8 is reduced, the first NMOS transistor MN 51 has a high resistance value due to a small voltage at the eighth node N8. At this time, a resistance ratio of the first NMOS transistor MN51 to the third NMOS transistor MN53 is enlarged, so that a voltage having a relatively low ratio is applied between the drain electrode and the source electrode of the third NMOS transistor MN53 while a voltage having a relatively enlarged ratio is applied between the drain electrode and the source electrode of the first NMOS transistor MN51.

Further, the fourth NMOS transistor MN54 is turned on by a third voltage applied from the third voltage line TVL into the gate electrode thereof, thereby constantly keeping a voltage difference between the drain and the source of the second NMOS transistor MN52. This is caused by a fact that the fourth NMOS transistor MN54 keeps a constant resistance value even though a current amount of the second NMOS transistor MN52 varies; while a resistance value of the second NMOS transistor MN52 is varied in contrary to a voltage at the eighth node N8 varying at the same type as a current amount at the data line DL.

If a current amount at the data line DL is increased, that is, if a voltage at the eighth node N8 is increased, then the second NMOS transistor MN52 has a low resistance value due to a high voltage at the eighth node N8. At this time, a resistance ratio of the second NMOS transistor MN52 to the fourth NMOS transistor MN54 is reduced, so that a voltage having a relatively large ratio is applied between the drain and the source of the fourth NMOS transistor MN54 while a voltage having a relatively reduced ratio is applied between the drain and the source of the second NMOS transistor MN52.

As a result, a voltage applied between the drain electrode and the source electrode of the second NMOS transistor MN52 does not almost vary even though a current amount at the eighth node N8 is increased. Otherwise, if a current amount at the data line DL is reduce, that is, if a voltage at the eighth node N8 is reduced, then the second NMOS transistor MN 52 has a high resistance value due to a small voltage at the eighth node N8. At this time, a resistance ratio of the second NMOS transistor MN52 to the fourth NMOS transistor MN54 is increased, so that a voltage having a relatively low ratio is applied between the drain electrode and the source electrode of the fourth NMOS transistor MN54 while a voltage having a relatively increased ratio is applied between the drain electrode and the source electrode of the second NMOS transistor MN52. Ultimately, a voltage applied between the drain electrode and the source electrode of the second NMOS transistor MN52 does almost not vary even though a voltage at the eighth node N8 (or a current amount at the data line DL) varies.

As described above, the current driver CD in FIG. 11 constantly keeps a voltage between the drain electrode and the source electrode of the second NMOS transistor MN52 independently of a voltage at the eighth node N8 and a current amount variation at the data line DL. Accordingly, a certain data line DL on the EL panel is almost not influenced by a current or a voltage at other data line Dl being adjacent thereto. In other words, the current driver CD in FIG. 11 allows a signal at a certain data line on the EL panel to have a current amount with an accurate magnitude corresponding to a voltage of a pixel signal without an affect of a signal at the adjacent data line.

In the mean time, the current driver CD is provided at a non-display area on the EL panel as shown in FIG. 4. Alternatively, in another embodiment of the present invention, current drivers CD may be included within a data driver 34 as shown in FIG. 12.

Figure 12:
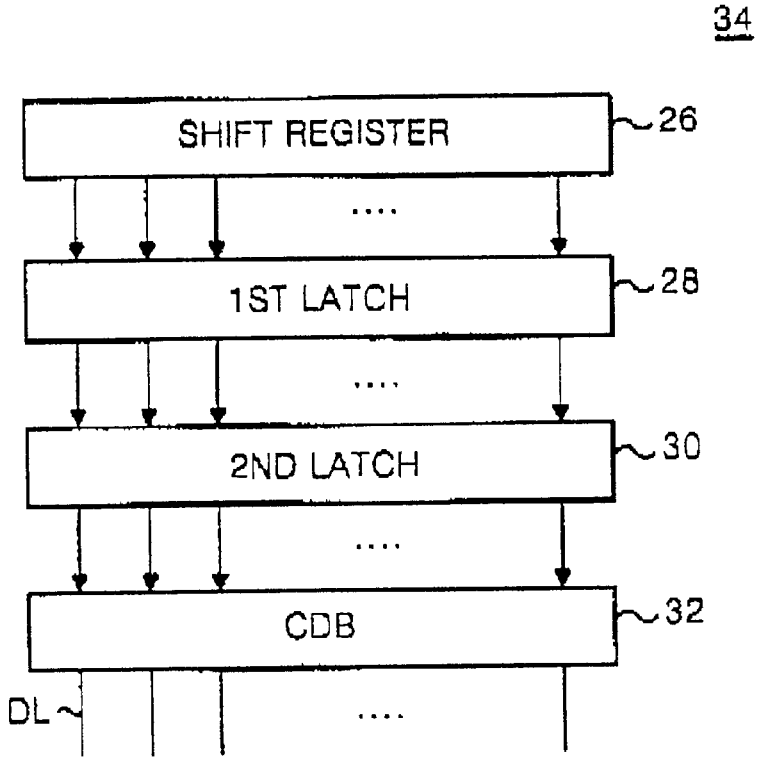
FIG. 12 is a block circuit diagram of a data driver according to an embodiment of the present invention.

Referring to FIG. 12, the data driver 34 according to another embodiment of the present invention includes a shift resister 26, a first latch 28, a second latch 30 and a current driver block CDB. The shift register 26 responds to a start pulse applied from a controller (not shown) to sequentially apply a shift clock to the first latch 28. The first latch 28 responds to a shift clock from the shift register 26 to sequentially store a data supplied from a data supplier (not shown). After all the data were stored in the first latch 28, a data stored in the first latch 28 is shifted into the second latch 30. At this time, the data having been stored in the second latch 30 is moved into the current driver block CDB. The current driver block CDB drives a pixel element PE to generate a light corresponding to a data value.

Figure 13:
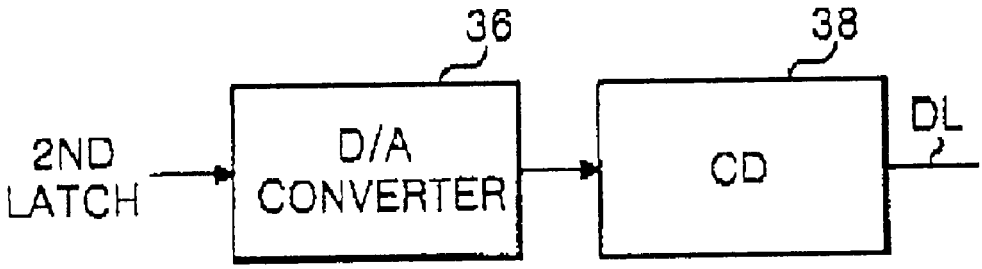
FIG. 13 is a detailed block diagram of the current driver shown in FIG. 12.

To this end, as shown in FIG. 13, the current driver block CDB consists of a digital to analog (D/A) converter 36 and a current driver CB. The D/A converter 36 converts a digital data sent from the second latch 30 into an analog data (i.e., analog voltage). The current driver CB drives the pixel element PE to generate a light corresponding to an analog data supplied from the D/A converter 36.

As described above, according to the present invention, a current amount flowing from the pixel into the data line is controlled to increase a maximum value of a current amount flowing in the EL cell. Also, the current mirror allows a current applied to the EL cell to be varied into a magnitude corresponding to several to tens of times the current amount at the data line, thereby enlarging a difference in a current amount of a pixel signal for discriminating a gray scale level. Accordingly, the EL panel according to the present invention can display a gray scale of picture. Furthermore, the EL panel can supply an accurate magnitude of current amount corresponding to a voltage of a pixel signal without an affect of a signal at the adjacent data lines.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electro-luminescence display, comprising:
   - a plurality of gate lines;
   - a plurality of data lines arranged in such a manner to cross the gate lines;
   - electro-luminescence cells provided at each intersection between the gate lines and the data lines;
   - cell driving means, being provided at each of the electro-luminescence cells, for responding to a signal at the data lines to control a light quantity emitted from the electro-luminescence cells;
   - a data driver for supplying a voltage pixel signal to the data lines; and
   - a plurality of current drivers for responding to the voltage pixel signal to control a current amount going through the data lines from the cell driving means.

2. The electro-luminescence display according to claim 1, wherein the cell driving means includes:
   - a first current path for allowing a current to flow into the data line; and
   - a second current path for allowing a current having several to tens of times the difference in quantity in comparison to a current amount going through the first current path to be applied to the electro-luminescence cell.

3. The electro-luminescence display according to claim 1, wherein each of the current drivers includes:
   - a transistor for responding to the voltage pixel signal to control a current amount flowing from the data line into a low voltage source.

4. The electro—luminescence display according to claim 3, further comprising:
   - a resistor connected between the transistor and the a low voltage source.

5. The electro-luminescence display according to claim 3, wherein the low voltage source generates any one of a ground voltage and a negative voltage.

6. The electro-luminescence display according to claim 1, wherein each of the current drivers includes:
   - a resistor voltage divider connected between the data driver and the low voltage source to generate at least two divided-voltage signals; and
   - at least two transistors connected, in series, between the data line and the low voltage source to respond to said at least two divided-voltage signals.

7. The electro-luminescence display according to claim 6, further comprising:
   - a resistor connected between said at least two transistors and the low voltage source.

8. The electro-luminescence display according to claim 6, wherein the low voltage source generates any cane of a ground voltage and a negative voltage.

9. The electro-luminescence display according to claim 1, wherein each of the current drivers includes:
   - a current repeater, being connected between the data line and the low voltage source, for responding to the voltage pixel signal to control a current amount flowing from the data line into the low voltage source.

10. The electro-luminescence display according to claim 9, wherein the low voltage source generates any one of a ground voltage and a negative voltage.

11. The electro-luminescence display according to claim 1, wherein the current drivers are provided within the data driver.

12. The electro-luminescence display according to claim 1, wherein the current drivers are provided between the data driver and the cell driving means.

13. An electro-luminescence display, comprising:

a plurality of gate lines;

a plurality of data lines arranged in such a manner to cross the gate lines;

electro-luminescence cells provided at each intersection between the gate lines and the data lines;

cell driving means, being provided at each of the electro-luminescence cells, for responding to a signal at the data lines to control a light quantity emitted from the electro-luminescence cells;

a data driver for supplying a voltage pixel signal to the data lines;

a gate driver for supplying a driving signal to the gate lines;

a plurality of current drivers for responding to the voltage pixel signal to control a current amount going through the data lines from the cell driving means; and a plurality of pads provided at the current drivers to receive the voltage pixel signal.

14. The electro-luminescence display according to claim 13, wherein each of the current drivers includes:

a low-voltage source having any one of a ground voltage and a negative voltage;

a transistor provided between the data line and the low voltage source; and a resistor provided between the transistor and the low voltage source.

15. The electro-luminescence display according to claim 13, wherein each of the current drivers includes:

a low voltage source having any one of a ground voltage and a negative voltage;

at least three resistors connected, in series, between the pad and the low voltage source; and at least two transistors connected, in series, between the data line and the low voltage source.

16. The electro-luminescence display according to claim 15, wherein each gate electrode of the transistors are connected between the resistors.

17. The electro-luminescence display according to claim 13, wherein each of the current drivers includes:

a low voltage source having any one of a ground voltage and a negative voltage;

a resistor and a first transistor connected, in series, between the pad and the low voltage source; and a second transistor provided between the data line and the low voltage source.

18. The electro-luminescence display according to claim 17, wherein a source electrode and a gate electrode of the first transistor are electrically connected to each other, and the gate electrode of the first transistor is connected to a gate electrode of the second transistor.

19. The electro-luminescence display according to claim 17, further comprising:

a third transistor provided between the second transistor and the data line.

20. The electro-luminescence display according to claim 19, wherein a gate electrode of the third transistor is connected to the source electrode of the first transistor, and a drain electrode of the third transistor is connected to the gate electrodes of the first and second transistors.

21. The electro-luminescence display according to claim 17, further comprising:

a third transistor provided between the resistor and the first transistor; and a fourth transistor provided between the data line and the second transistor.

22. The electro-luminescence display according to claim 21, wherein a source electrode of the third transistor is connected to the gate electrodes of the first and second transistors.

23. The electro-luminescence display according to claim 21, further comprising:

a bias voltage source connected to gate electrodes of the third and fourth transistors to apply a driving voltage for driving the third and fourth transistors.

24. The electro-luminescence display according to claim 21, wherein the resistor is a variable resistor.

* * * * *